US007499012B2

(12) United States Patent
Yoshihara et al.

(10) Patent No.: US 7,499,012 B2
(45) Date of Patent: Mar. 3, 2009

(54) LIQUID CRYSTAL DISPLAY DEVICE

(75) Inventors: Toshiaki Yoshihara, Kawasaki (JP); Tetsuya Makino, Kawasaki (JP); Shinji Tadaki, Kawasaki (JP); Hironori Shiroto, Kawasaki (JP); Yoshinori Kiyota, Kawasaki (JP); Shigeo Kasahara, Kawasaki (JP); Keiichi Betsui, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 567 days.

(21) Appl. No.: 10/930,414

(22) Filed: Aug. 31, 2004

(65) Prior Publication Data

US 2005/0212737 A1 Sep. 29, 2005

(30) Foreign Application Priority Data

Mar. 29, 2004 (JP) ..... 2004-095106

(51) Int. Cl.
*G09G 3/36* (2006.01)

(52) U.S. Cl. ..... 345/97; 345/98

(58) Field of Classification Search ..... 345/96, 345/98, 99, 100, 87, 97; 455/566
See application file for complete search history.

(56) References Cited

U.S. PATENT DOCUMENTS 5,546,104 A * 8/1996 Kuga ..... 345/99
5,844,534 A * 12/1998 Okumura et al. ..... 345/100
6,069,604 A 5/2000 Verhulst
6,628,971 B1 * 9/2003 Yoon et al. ..... 455/566
6,710,759 B1 * 3/2004 Kondoh ..... 345/92
6,771,247 B2 * 8/2004 Sato et al. ..... 345/98
6,940,481 B2 * 9/2005 Konno et al. ..... 345/96

FOREIGN PATENT DOCUMENTS

| | | |
|---|---|---|
| JP | A 5-94152 | 4/1993 |
| JP | 11-119189 | 4/1999 |
| JP | 2002-278523 | 9/2002 |
| KR | 2001-0067394 | 7/2001 |
| WO | WO 01/13167 | 2/2001 |

OTHER PUBLICATIONS

Yoshihara et al.; A Full-Color Video Rate FLC Display Based on a Time Domain Color Switching with a TFT Array; 17rh International Liquid Crystal Conference; p. 25, P1-74; Jul. 19-24, 1998; Strasbourg, France.

(Continued)

*Primary Examiner*—Kevin M Nguyen
(74) *Attorney, Agent, or Firm*—Greer, Burns & Crain, Ltd.

(57) ABSTRACT

After rewriting the displayed image by applying a voltage corresponding to desired image data to a ferroelectric liquid crystal through TFTs at a predetermined cycle, the application of voltage to the ferroelectric liquid crystal is stopped, and the image displayed just before stopping the application of voltage is retained. In this memory display period, a gate-off voltage is applied to turn off the TFTs. In this memory display period, the emission intensity of a back-light is lowered compared to that in a normal display period. Before stopping the application of voltage to the ferroelectric liquid crystal, a voltage corresponding to an image to be displayed after stopping the application of voltage is applied. Before resuming the application of voltage corresponding to the image data to the ferroelectric liquid crystal, a voltage for causing all pixels to display black image is applied.

14 Claims, 14 Drawing Sheets

OTHER PUBLICATIONS

Yoshihara et al.; A Full-Color FLC Display Based on Field Sequential Color with TFTs; AM-LCD '99 Digest of Technical Papers; pp. 185-188; Jul. 14-16, 1999; Tokyo, Japan.

Yoshihara et al.; Invited Paper: A 254-ppi Full-color Video Rate TFT-LCD Based on Field Sequential Color and FLC Display; SID '00 Digest of Technical Papers; pp. 1176-1177; May 2000.

* cited by examiner

LIQUID CRYSTAL DISPLAY DEVICE

CROSS-REFERENCE TO RELATED APPLICATION

This non-provisional application claims priority under 35 U.S.C. §119(a) on Patent Application No. 2004-95106 filed in Japan on Mar. 29, 2004, the entire contents of which are hereby incorporated by reference.

BACKGROUND OF THE INVENTION

The present invention relates to a liquid crystal display device, and more particularly relates to a liquid crystal display device having a memory display function for displaying an image during stopping the application of voltage to a liquid crystal material.

Along with the recent development of so-called information-oriented society, electronic apparatuses, such as personal computers and PDA (Personal Digital Assistants), have been widely used. With the spread of such electronic apparatuses, portable apparatuses that can be used in offices as well as outdoors have been used, and there are demands for small-size and light-weight of these apparatuses. Liquid crystal display devices are widely used as one of the means to satisfy such demands. Liquid crystal display devices not only achieve small size and light weight, but also include an indispensable technique in an attempt to achieve low power consumption in portable electronic apparatuses that are driven by batteries.

The liquid crystal display devices are mainly classified into the reflection type and the transmission type. In the reflection type liquid crystal display devices, light rays incident from the front face of a liquid crystal panel are reflected by the rear face of the liquid crystal panel, and an image is visualized by the reflected light; whereas in the transmission type liquid crystal display devices, the image is visualized by the transmitted light from a light source (back-light) placed on the rear face of the liquid crystal panel. The reflection type liquid crystal display devices have poor visibility because the reflected light amount varies depending on environmental conditions, and therefore transmission type color liquid crystal display devices using color filters are generally used as display devices of, particularly, personal computers that display full-color images.

As the color liquid crystal display devices, currently, active matrix liquid crystal display devices using switching elements such as TFT (Thin Film Transistor) are widely used. Although the TFT-driven liquid crystal display devices have relatively high display quality, they require a back-light with high intensity to achieve high display brightness because the light transmittance of the liquid crystal panel is only several % at present. Consequently, a lot of power is consumed by the back-light. In addition, since the responsiveness of liquid crystal to an electric field is low, there is a problem of low response speed, particularly low half-tone response speed. Moreover, since the color display is realized using color filters, a single pixel needs to be composed of three sub-pixels, and therefore it is difficult to achieve a high-resolution display and sufficient color purity in the display.

In order to solve such problems, the present inventor et al. developed field-sequential liquid crystal display devices (see, for example, T. Yoshihara, et al., ILCC 98, P1-074, 1998; T. Yoshihara, et al., AM-LCD '99 Digest of Technical Papers, p. 185, 1999; T. Yoshihara, et al., SID '00 Digest of Technical Papers, p. 1176, 2000). Since such a field-sequential liquid crystal display device does not require sub-pixels, it is possible to easily realize a higher resolution display compared to a color-filter type liquid crystal display device. Moreover, since the field-sequential liquid crystal display device can use the color of light emitted by the light source as it is for display without using a color filter, the displayed color has excellent purity. Further, since the light utilization efficiency is high, the field-sequential liquid crystal display device has the advantage of low power consumption. However, in order to realize a field-sequential liquid crystal display device, high-speed responsiveness (2 ms or less) of liquid crystal is essential.

In order to provide a field-sequential liquid crystal display device with significant advantages as mentioned above or increase the speed of response of a color-filter type liquid crystal display device, the present inventor et al. are conducting research and development on the driving of liquid crystal such as a ferroelectric liquid crystal having spontaneous polarization, which may achieve 100 to 1000 times faster response compared to a prior art, by a switching element such as TFT (see, for example, Japanese Patent Application Laid-Open No. 11/119189 (1999)). In the ferroelectric liquid crystal, the long-axis direction of the liquid crystal molecule is tilted by the application of voltage. A liquid crystal panel holding the ferroelectric liquid crystal therein is sandwiched by two polarization plates whose polarization axes are crossed Nicols to each other, and the intensity of transmitted light is changed using the birefringence caused by the change in the long-axis direction of the liquid crystal molecule. For such a liquid crystal display device, a ferroelectric liquid crystal having a half-V shaped electro-optic response characteristic to the applied voltage as shown in FIG. 1 (characteristic exhibiting high light transmittance when a voltage of one polarity is applied and exhibiting lower light transmittance (low light transmittance practically recognized as a black image) when a voltage of the other polarity is applied as compared to the application of voltage of the one polarity) is generally used as a liquid crystal material.

As described above, the field-sequential liquid crystal display device has high light utilization efficiency and can reduce power consumption compared to the color-filter type liquid crystal display device. However, a further reduction in power consumption is required for portable apparatuses that are driven by batteries. Similarly, color-filter type liquid crystal display devices are required to reduce power consumption.

BRIEF SUMMARY OF THE INVENTION

The following description will explain the display function, particularly a memory display function, of a liquid crystal display device using a ferroelectric liquid crystal having spontaneous polarization or the like. Such a liquid crystal display device has a normal display function that rewrites the displayed image at a predetermined cycle by applying a voltage to the liquid crystal, and a memory display function that stops the application of voltage to the liquid crystal and retains the image displayed before stopping the application of voltage. In the memory display function, after removing all voltages applied to the liquid crystal by switching elements such as TFT, the display state just before the removal of applied voltage is substantially retained, and therefore it is possible to display the image without applying a voltage to the liquid crystal material and significantly reduce power consumption. Thus, such a liquid crystal display device is applicable to portable apparatuses, and has a significant effect of reducing power consumption, especially on portable apparatuses that often display still images.

The memory function of the ferroelectric liquid crystal having spontaneous polarization is described below. A voltage is applied to a liquid crystal panel, and then the voltage is removed by stopping the application of voltage. The light transmittance during the application of voltage and the light transmittance at 60 seconds after the start of the memory display are measured while changing the value of the applied voltage, and one example of the measurement results is shown in FIG. 2. FIG. 2 shows the measurement results by plotting the applied voltage (V) on the abscissa and the light transmittance (%) on the ordinate, wherein ○-○ represents the light transmittance during the application of voltage, and Δ-Δ represents the light transmittance at 60 seconds after the start of the memory display. The corresponding applied voltage-light transmittance characteristics does not change even after the removal of applied voltage, and thus it can be understood that even when the voltage applied to the liquid crystal panel is removed, the light transmittance corresponding to the display state when the voltage is applied is maintained. Moreover, a black image (light transmittance: substantially 0%, applied voltage: substantially 0 V) shows no change during the application of voltage and the absence of applied voltage, and the display state is retained.

For the liquid crystal panel, a change in the light transmittance after removal of voltage is measured against time, and the measurement results are shown in FIGS. 3A and 3B. As shown in FIG. 3A, a 5V, 5 μs pulse wave voltage is applied to the liquid crystal panel, and the light transmittance is measured against time. FIG. 3B shows the measured light transmittance by plotting the time (ms) on the abscissa and the light transmittance (arbitrary unit) on the ordinate. It can be understood that the light transmittance increases abruptly at the moment the voltage is applied and then attenuates gradually, but the attenuation is not seen 100 ms after the removal of voltage and the liquid crystal panel maintains a certain light transmittance.

It can be understood from the above description that the ferroelectric liquid crystal has the memory function, and even when the applied voltage is removed, the liquid crystal molecules maintain the state corresponding to the data displayed before the removal of voltage. Thus, in a liquid crystal display device using a ferroelectric liquid crystal having such a memory function, when a voltage corresponding to the display information for one screen is applied once, a certain display corresponding to the applied voltage can be maintained without continuing the application of voltage, until a voltage corresponding to the display information for the next screen is applied. Consequently, it is possible to retain the display without applying the voltage, thereby enabling a reduction in power consumption.

The present invention has been made under the above circumstances, and it is an object of the present invention to provide a liquid crystal display device capable of reducing power consumption.

Another object of the present invention is to provide a liquid crystal display device capable of realizing sufficient liquid crystal response and high memory ability.

A liquid crystal display device according to a first aspect of the invention comprises: a liquid crystal material sealed in a gap formed by at least two substrates; and switching elements corresponding to respective pixels, for controlling selection/non-selection of voltage application to control light transmittance of the liquid crystal material, and has a first display function that displays an image by applying a voltage to the liquid crystal material through the switching elements, and a second display function that stops the application of voltage to the liquid crystal material through the switching elements and retains a display state just before the application of voltage is stopped, wherein the switching elements are turned off while the second display function is being executed.

In the liquid crystal display device of the first aspect, a voltage (gate-off voltage) for turning off the switching elements (TFT) is applied while the second display function (memory display function) is being executed. Consequently, it is possible to stably maintain an amount of charges in each pixel for determining a plurality of display states of different brightness by the liquid crystal and obtain a stable display state. In the case where the switching elements (TFT) are not turned off, for example, there is a possibility that light strikes the switching elements (TFT) and the characteristics thereof become instable during the execution of the second display function (memory display function), and the charges stored in the liquid crystal cell may flow out through the switching elements (TFT). Therefore, in the first aspect, the switching elements (TFT) are turned off during the execution of the second display function (memory display function), and a leak current through the switching elements (TFT) is prevented even when the switching elements (TFT) are illuminated with particularly strong light. As a result, it is possible to realize a stable memory display. Moreover, even when a mono-stable liquid crystal material as well as a bi-stable liquid crystal is used, it is possible to realize a memory display. Thus, since this liquid crystal display device can realize a stable memory display, it is possible to significantly reduce the number of times of voltage application to the liquid crystal material through the switching elements (TFT), thereby reducing power consumption.

A liquid crystal display device according to a second aspect of the invention is based on the first aspect, and comprises means for performing switching from the first display function to the second display function.

In the liquid crystal display device of the second aspect, a memory display is executed by stopping the application of voltage to the liquid crystal material at a predetermined timing. It is therefore possible to realize a stable memory display even with a liquid crystal display device that displays an image by line scanning. In particular, in a liquid crystal display device using switching elements (TFT), since a liquid crystal having a half-V shaped electro-optic response characteristic as shown in FIG. 1 is generally used, data writing scanning is performed two or more times with a voltage of one polarity and a voltage of the other polarity in each frame or each sub-frame. In a field-sequential type liquid crystal display device, it is preferred that the voltages applied in the respective writing scanning operations have the same polarity for all pixels. In a color-filter type liquid crystal display device, it is not necessarily to perform writing scanning with voltages of the same polarity on all pixels, but it is preferred to perform writing scanning with voltages of the same polarity for a memory display. Further, by stopping the application of voltage to the liquid crystal material at a desired timing after completion of writing scanning with a voltage of one polarity capable of realizing a high light transmittance but before the start of the next writing scanning with a voltage of the other polarity, it is possible to realize a stable memory display. Examples of switching from the first display function (normal display function) that rewrites the displayed image by the application of a voltage to the second display function (memory display function) that removes the applied voltage and retains the displayed image are as follows. For example, when image data to be displayed is still-image data or when an operating input has not been entered by a user over a predetermined period of time, switching from the first display function (normal display function) to the second display function (memory display function) is executed automatically. Alternatively, according to an instruction of the user to request a display by the second display function, switching from the first display function (normal display function) to the second display function (memory display function) is performed manually.

A liquid crystal display device according to a third aspect of the invention is based on the first or second aspect, and comprises a light source for display, wherein the light source has different emission intensities between the first display function and the second display function.

In the liquid crystal display device of the third aspect, the light source has different emission intensities between the first display function (normal display function) that rewrites the displayed image by applying a voltage and the second display function (memory display function) that removes the applied voltage and retains the displayed image. For the second display function (memory display function), the emission intensity of the light source for display is lowered compared to that for the first display function (normal display function) so as to reduce power consumption. In the case where a liquid crystal material having a half-V shaped electro-optic characteristic as shown in FIG. 1 is used, a light transmittance about twice that in the normal display is obtained during the memory display. Therefore, during the memory display, even when the emission intensity of the light source for display is lowered, it is possible to realize display brightness equal to that during the normal display, thereby reducing power consumption. Thus, by changing the emission intensity of the light source for display according to a display mode, it is possible to finely adjust the display brightness and prevent the light source for display from excessively consuming power.

According to a liquid crystal display device of a fourth aspect of the invention, in any one of the first through third aspects, before stopping the application of voltage to the liquid crystal material, a voltage corresponding to an image to be displayed after stopping the application of voltage is applied to the liquid crystal material.

In the liquid crystal display device of the fourth aspect, before stopping the application of voltage to the liquid crystal material, write scanning is performed with a voltage corresponding to a monochrome image or a mono-color image to be displayed after stopping the application of voltage. Consequently, it is possible to certainly write image data for the memory display that is different from image data for the normal display, thereby realizing a desired memory display.

According to a liquid crystal display device of a fifth aspect of the invention, in any one of the first through fourth aspects, all pixels are caused to display black image before resuming the application of voltage to the liquid crystal material to return to the first display function from the second display function.

In the liquid crystal display device of the fifth aspect, when resuming the application of voltage to the liquid crystal material, first, all pixels are caused to display black image, and then a voltage corresponding to data to be displayed is applied to the liquid crystal material. Therefore, a black-base image is definitely shown after resuming the application of voltage, and a clear image is obtained. If all pixels are not caused to display black image once when resuming the application of voltage, a problem occurs. For example, if the image retained when no voltage is applied is an image other than black image, especially a white image, a white-base image is shown when the application of voltage is started, and a desired image cannot be obtained. This problem is particularly noticeable when a bi-stable liquid crystal material is used, but the fifth aspect can prevent this problem.

A liquid crystal display device according to a sixth aspect of the invention is based on any one of the first through fifth aspects, wherein the liquid crystal material is a ferroelectric liquid crystal material.

In the liquid crystal display device of the sixth aspect, a ferroelectric liquid crystal material is used as the liquid crystal material. It is therefore possible to realize a stable memory display.

A liquid crystal display device according to a seventh aspect of the invention is based on any one of the first through sixth aspects, wherein the liquid crystal display device is of transmission type, reflection type, or semi-transmission type.

The liquid crystal display device of the seventh aspect is either a transmission type liquid crystal display device, a reflection type liquid crystal display device, or a semi-transmission type liquid crystal display device. If the liquid crystal display device is of transmission type, the memory display can reduce power consumption, but the semi-transmission type or reflection type liquid crystal display device can further reduce power consumption.

A liquid crystal display device according to an eighth aspect of the invention is based on any one of the first through seventh aspects, and displays a color image by a color-filter method.

The liquid crystal display device of the eighth aspect displays a color image by a color-filter method using color filters. It is therefore possible to easily realize a color display.

A liquid crystal display device according to a ninth aspect of the invention is based on any one of the first through seventh aspects, and displays a color image by a field-sequential method.

The liquid crystal display device of the ninth aspect displays a color image by a filed-sequential method in which lights of a plurality of colors are switched with the passage of time. It is therefore possible to realize a color display having high-resolution, high color purity and high-speed response.

The above and further objects and features of the invention will more fully be apparent from the following detailed description with accompanying drawings.

DETAILED DESCRIPTION OF THE INVENTION

The following description will specifically explain the present invention with reference to the drawings illustrating some embodiments thereof. Note that the present invention is not limited to the following embodiments.

First Embodiment

Figure 4:
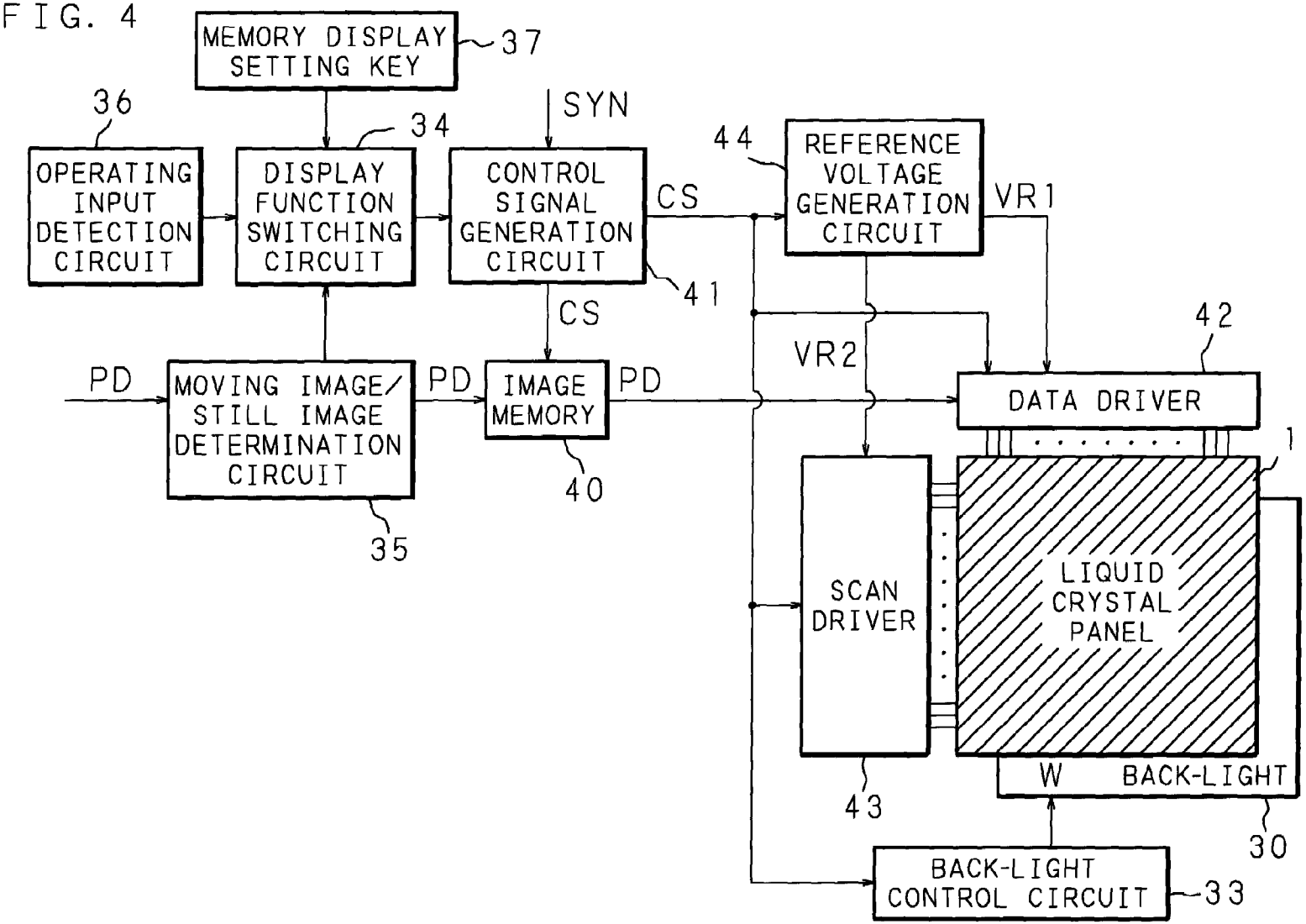
FIG. 4 is a block diagram showing the circuit structure of a liquid crystal display device of a first embodiment (color-filter type)
Figure 5:
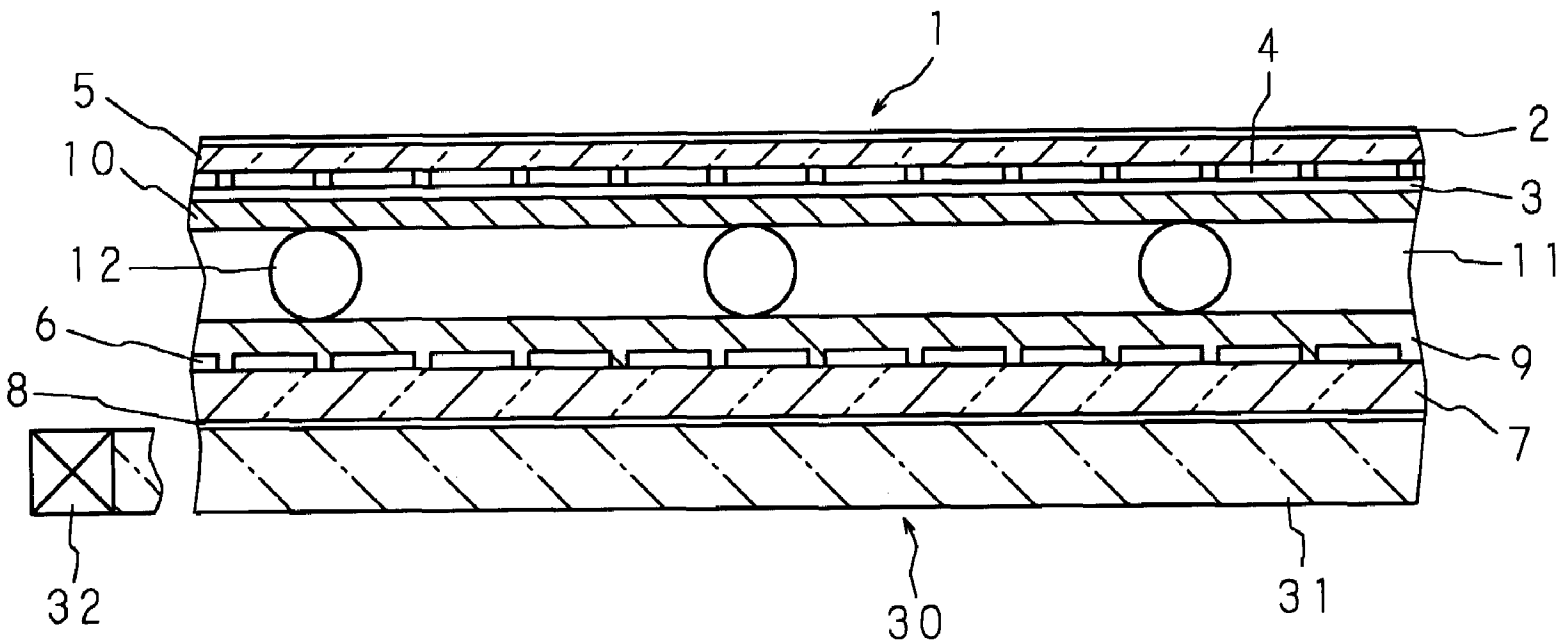
FIG. 5 is a schematic cross sectional view of a liquid crystal panel and back-light of the liquid crystal display device of the first embodiment.
Figure 6:
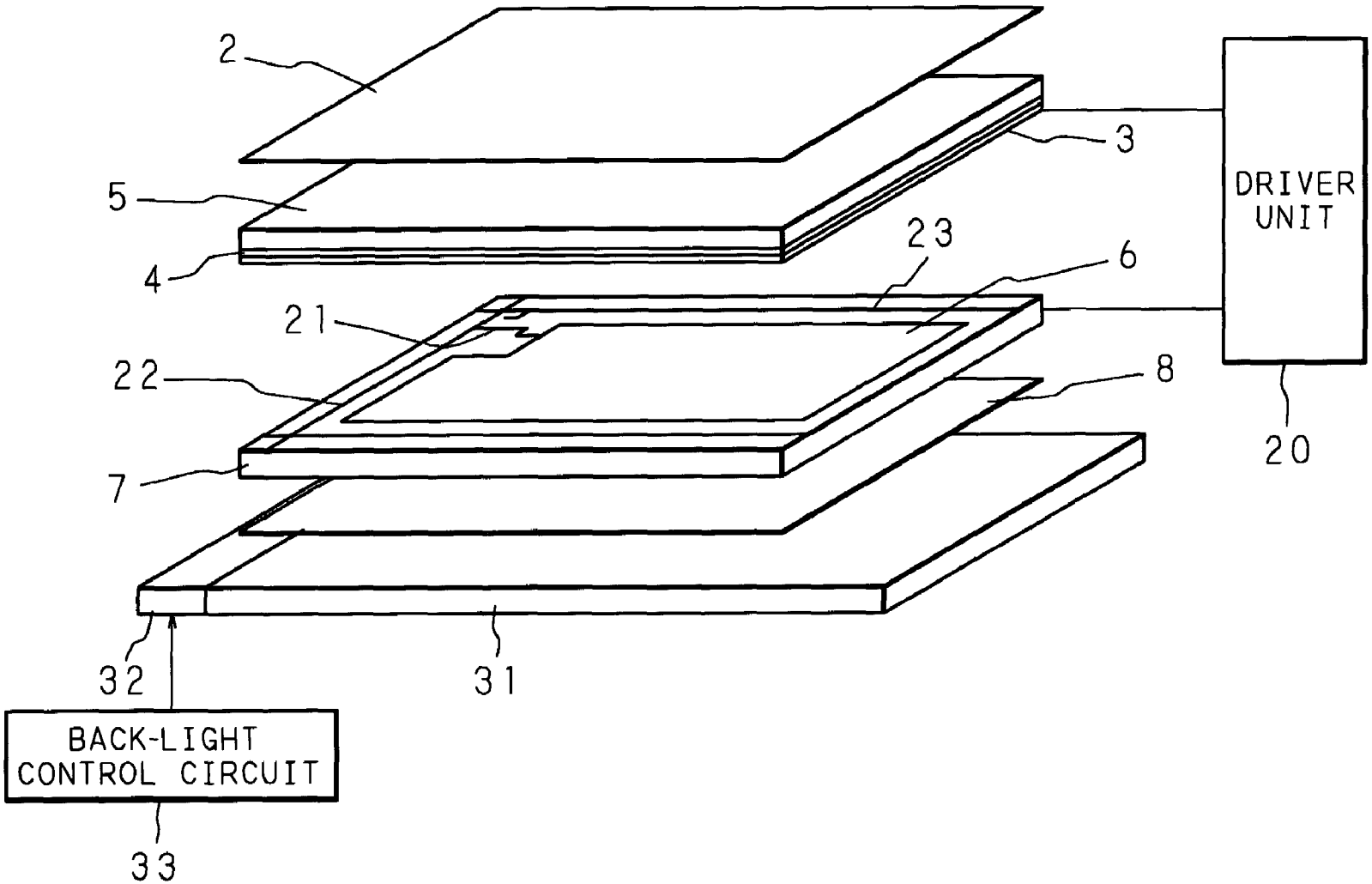
FIG. 6 is a schematic view showing an example of the overall structure of the liquid crystal display device of the first embodiment.

FIG. 4 is a block diagram showing the circuit structure of a liquid crystal display device of the first embodiment; FIG. 5 is a schematic cross sectional view of a liquid crystal panel and a back-light of the liquid crystal display device; and FIG. 6 is a schematic view showing an example of the overall structure of the liquid crystal display device. The first embodiment is a liquid crystal display device for displaying color images by a color filter method.

In FIG. 4, the numerals 1 and 30 represent a liquid crystal panel and a back-light whose cross sectional structures are shown in FIG. 5. As shown in FIG. 5 and FIG. 6, the liquid crystal panel 1 comprises a polarization film 2; a glass substrate 5 having a common electrode 3 and color filters 4 arranged in a matrix form; a glass substrate 7 having pixel electrodes 6 arranged in a matrix form; and a polarization film 8, which are stacked in this order from the upper layer (front face) side to the lower layer (rear face) side.

A driver unit 20 comprising a data driver 42 and a scan driver 43 is connected between the common electrode 3 and the pixel electrodes 6. The data driver 42 is connected to TFTs 21 through signal lines 22, while the scan driver 43 is connected to the TFTs 21 through scanning lines 23. The TFTs 21 are controlled to be on/off by the scan driver 43. Further, each pixel electrode 6 is controlled to be on/off by the TFT 21. Therefore, the intensity of transmitted light of each individual pixel is controlled by a signal given from the data driver 42 through the signal line 22 and the TFT 21.

An alignment film 9 is provided on the upper face of the pixel electrodes 6 on the glass substrate 7, and an alignment film 10 is placed on the lower face of the common electrode 3. The space between these alignment films 9 and 10 is filled with a liquid crystal material to form a liquid crystal layer 11. Note that the numeral 12 represents spacers for maintaining a layer thickness of the liquid crystal layer 11.

The back-light 30 is disposed on the lower layer (rear face) side of the liquid crystal panel 1, and has an LED array 32 for emitting white light in a state in which it faces an end face of a light guiding and diffusing plate 31 that forms a light emitting area. The light guiding and diffusing plate 31 guides white light emitted from the respective LEDs of the LED array 32 to its entire surface and diffuses the light to the upper face, thereby functioning as the light emitting area. The ON/OFF and emission intensity of this back-light 30 (LED array 32) are adjusted by a back-light control circuit 33.

In FIG. 4, the numeral 34 represents a display function switching circuit for switching between a normal display function (first display function) that rewrites the displayed image by applying a voltage to the liquid crystal panel 1 and a memory display function (second display function) that stops the application of voltage to the liquid crystal panel 1 and retains the image displayed before stopping the application of voltage. Connected to the display function switching circuit 34 are a moving image/still image determination circuit 35 for determining whether pixel data PD inputted from a personal computer or the like is moving-image data or still-image data; an operating input detection circuit 36 for detecting whether or not a user's (operator's) operating input is present; and a memory display setting key 37 for receiving a setting to switch to the memory display function from a user. Normally, the normal display function is set, but when the moving image/still image determination circuit 35 determines that the pixel data PD is still-image data or when a user's operating input has not been detected over a predetermined period of time by the operating input detecting circuit 36, the display function switching circuit 34 automatically switches to the memory display function. When the user presses the memory display setting key 37, the normal display function is also switched to the memory display function. The display function switching circuit 34 outputs a signal indicating either of these display functions to a control signal generation circuit 41. The display function switching circuit 34, the moving image/still image determination circuit 35, the operating input detection circuit 36, and the memory display setting key 37 constitute a display control section. The control signal generation circuit 41 is supplied with a synchronous signal SYN from a personal computer or the like, and generates various control signals CS necessary for display. Pixel data PD is outputted from an image memory 40 to the data driver 42. Based on the pixel data PD and a control signal CS for changing the polarity of applied voltage, a voltage is applied to the liquid crystal panel 1 through the data driver 42.

Moreover, the control signal generation circuit 41 outputs a control signal CS to each of a reference voltage generation circuit 44, the data driver 42, the scan driver 43, and the back-light control circuit 33. The reference voltage generation circuit 44 generates reference voltages VR1 and VR2, and outputs the generated reference voltages VR1 and VR2 to the data driver 42 and the scan driver 43, respectively. The data driver 42 outputs a signal to the signal line 22 of the pixel electrodes 6 based on the pixel data PD from the image memory 40 and the control signals CS from the control signal generation circuit 41. In synchronism with the output of the signal, the scan driver 43 scans the scanning lines 23 of the pixel electrodes 6 sequentially on a line by line basis. Further, the back-light control circuit 33 applies a drive voltage to the back-light 30 so that white light with adjusted intensity is emitted from the back-light 30.

Next, the operation of the liquid crystal display device will be explained. The display function switching circuit 34 switches to either the normal display function or the memory display function. When the image data PD is still-image data and an operating input has not been given by the user over a predetermined period of time, or when the user presses the memory display setting key 37, the display is switched to the memory display function. Pixel data PD for display is inputted to the image memory 40 from a personal computer or the like through the moving image/still image determination circuit 35. When the image memory 40 receives a control signal CS from the control signal generation circuit 41 after storing the pixel data PD temporarily, it outputs the pixel data PD. The control signal CS generated by the control signal generation circuit 41 is supplied to the data driver 42, scan driver 43, reference voltage generation circuit 44, and back-light control circuit 33. The reference voltage generation circuit 44 generates reference voltages VR1 and VR2 upon receipt of the control signal CS, and outputs the generated reference voltages VR1 and VR2 to the data driver 42 and the scan driver 43, respectively.

When the data driver 42 receives the control signal CS, it outputs a signal to the signal line 22 of the pixel electrodes 6, based on the pixel data PD outputted from the image memory 40. When the scan driver 43 receives the control signal CS, it scans the scanning lines 23 of the pixel electrodes 6 sequentially on a line by line basis. According to the output of the signal from the data driver 42 and scanning performed by the scan driver 43, the TFTs 21 are driven and a voltage is applied to the pixel electrodes 6, thereby controlling the intensity of the transmitted light of the pixels. When the back-light control circuit 33 receives the control signal CS, it applies a drive voltage to the back-light 30 so as to cause the LEDs of the LED array 32 of the back-light 30 to emit white light. Thus, a color image is displayed by synchronizing the control to turn on the back-light 30 (LED array 32) for emitting incident light on the liquid crystal panel 1 with a plurality of times of data scanning on the liquid crystal panel 1.

Here, a specific example of the liquid crystal display device of the first embodiment is explained. After washing a TFT substrate having pixel electrodes 6 (320×3 (RGB)×240, 3.5-inch diagonal) and a common electrode substrate having a common electrode 3 and RGB color filters 4, they were coated with polyimide and baked for one hour at 200° C. to form about 200 Å thick polyimide films as alignment films 9 and 10.

Figure 1:
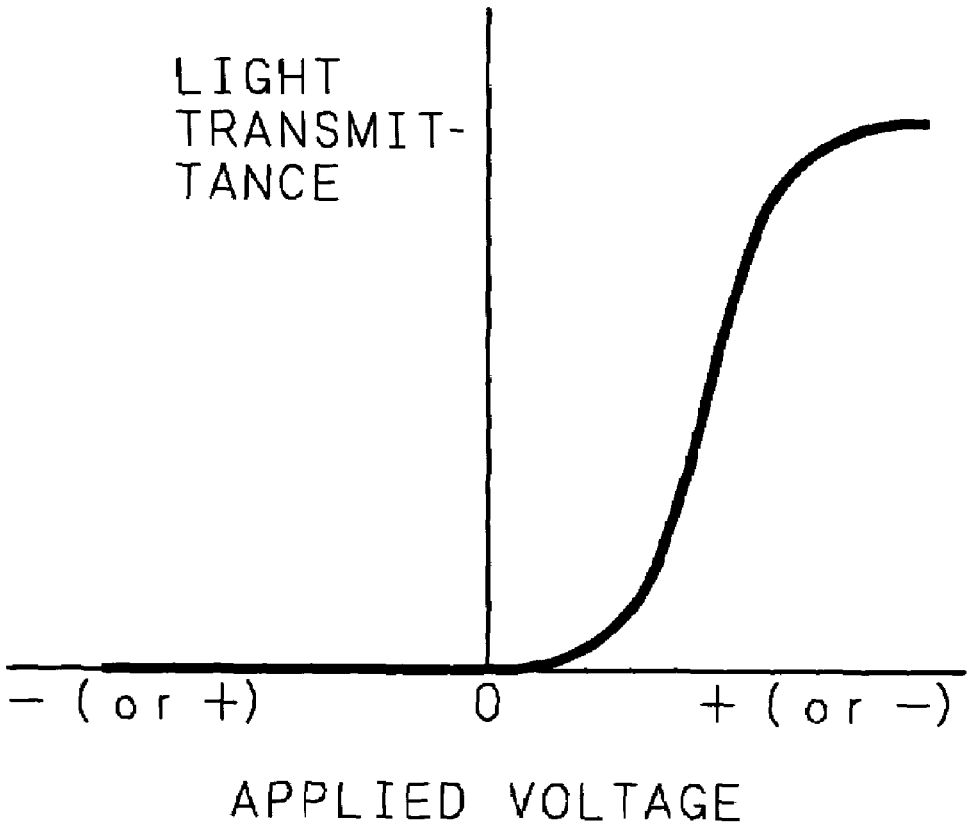
FIG. 1 PRIOR ART
FIG. 1 is a view showing one example of electro-optic characteristics of a liquid crystal material.

Further, these alignment films 9 and 10 were rubbed with rayon fabric, and an empty panel was produced by stacking these two substrates while maintaining a gap therebetween by spacers 12 made of silica having an average particle size of 1.6 μm. A liquid crystal layer 11 was formed by sealing a bi-stable ferroelectric liquid crystal material composed mainly of naphthalene-based liquid crystal showing a half-V shaped electro-optic response characteristic as shown in FIG. 1 during TFT driving in the empty panel. The magnitude of spontaneous polarization of the sealed ferroelectric liquid crystal material was about 7 nC/cm$^2$.

A liquid crystal panel 1 was produced by sandwiching the fabricated panel by two polarization films 2 and 8 arranged in a crossed-Nicol state so that a dark state is produced when the long axis direction of the ferroelectric liquid crystal molecules of the liquid crystal layer 11 is tiled in one direction. The liquid crystal panel 1 and a back-light 30 were stacked one upon another to achieve a color display by a color-filter method.

Figure 7:
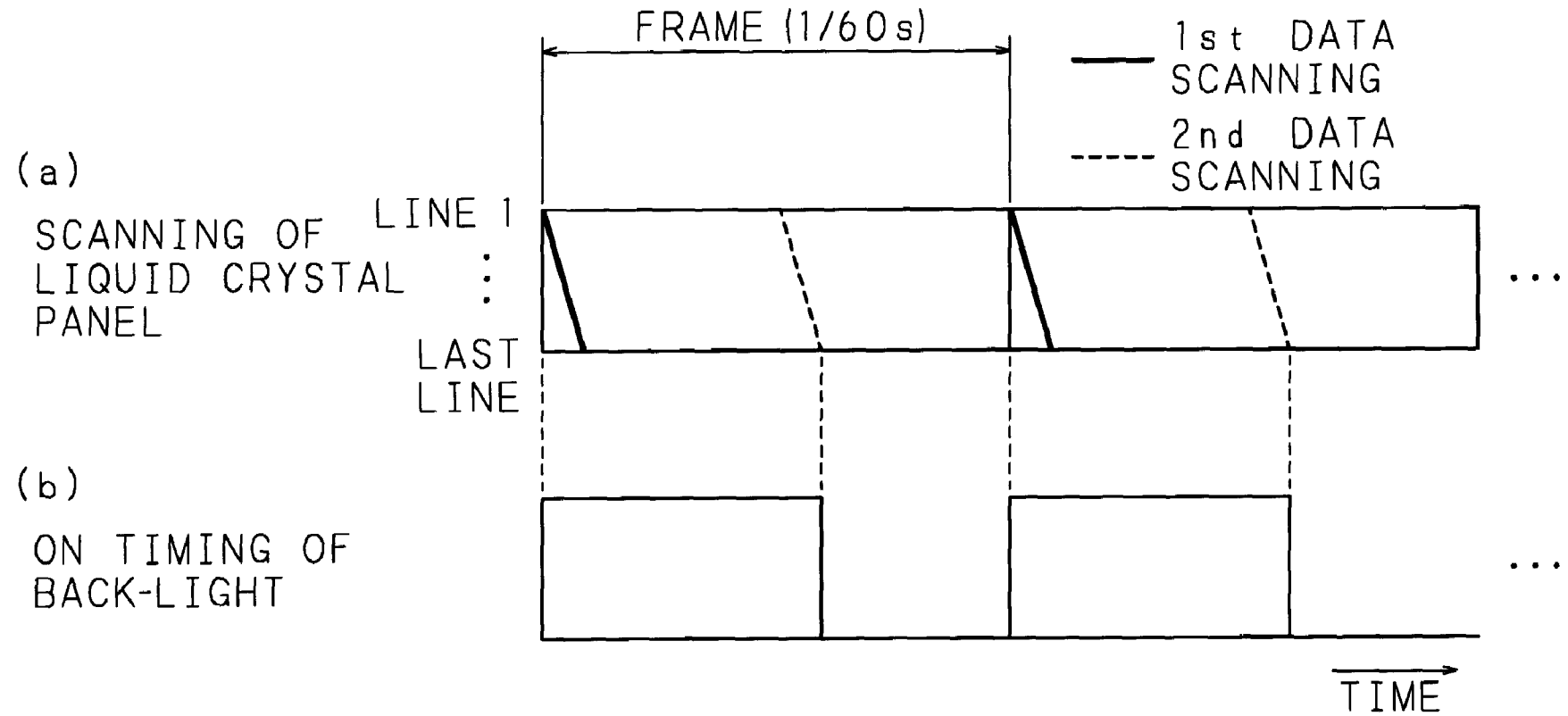
FIG. 7 is a drive sequence of the liquid crystal display device of the first embodiment.
Figure 8:
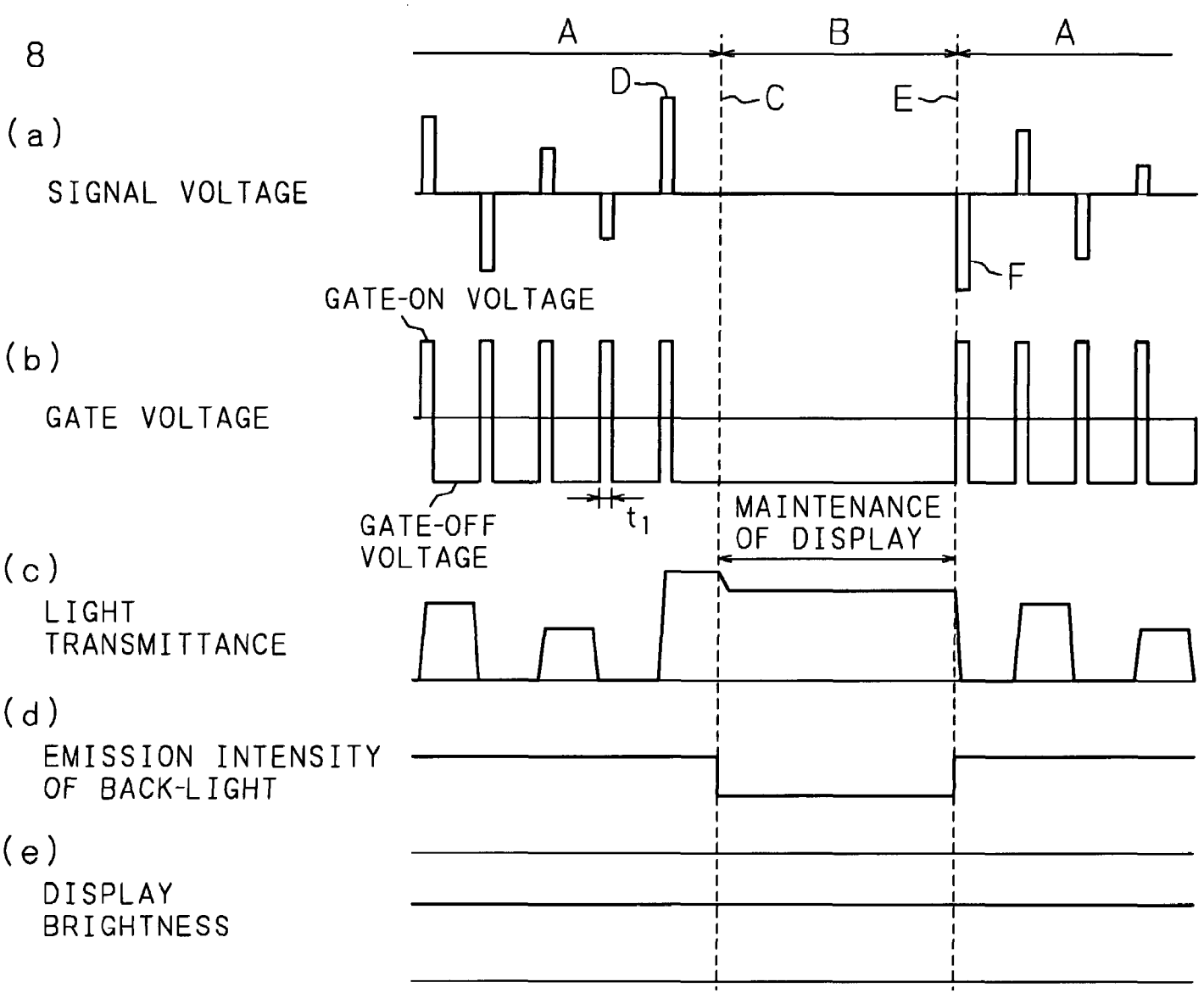
FIG. 8 is a drive sequence of a liquid crystal display device according to the first and second embodiments.

Next, a specific example of operation of the first embodiment is explained. FIG. 7 and FIG. 8 are timing charts showing one example of a drive sequence in this operation example. FIG. 7(*a*) shows the scanning timing of each line of the liquid crystal panel 1, and FIG. 7(*b*) shows the ON timing of the back-light 30. As shown in FIG. 7(*a*), image data writing scanning is performed twice in each frame on the liquid crystal panel 1. In the first data writing scanning, data writing scanning is performed in a polarity capable of realizing a bright display, and in the second data writing scanning, a voltage with the opposite polarity and substantially equal magnitude to that in the first data writing scanning is applied. Consequently, a darker display is realized compared to the first data writing scanning and practically recognized as a "black image".

FIG. 8(*a*) indicates the magnitude of a signal voltage applied to the ferroelectric liquid crystal to obtain a desired display; FIG. 8(*b*) indicates the gate voltage of the TFT 21, FIG. 8(*c*) indicates the light transmittance; FIG. 8(*d*) indicates the emission intensity of the back-light 30; and FIG. 8(*e*) indicates the display brightness. FIG. 8 shows a drive sequence on a selected line. It is possible to perform the normal display function (first display function) (period A) that rewrites the displayed image by applying a voltage to the ferroelectric liquid crystal at a predetermined cycle and the memory display function (second display function) (period B) that stops the application of voltage to the ferroelectric liquid crystal and retains the image displayed before stopping the application of voltage.

After applying a voltage corresponding to a desired image to the ferroelectric liquid crystal through the TFTs 21 on a line-by-line basis at the timing of gate-on voltage, the application of voltage to the liquid crystal panel 1 is stopped at a desired timing after completion of the application of voltage to the last line but before selecting the first line (timing C). However, in the data writing scanning just before stopping the application of voltage, a voltage (signal voltage D) corresponding to image data desired to be kept displayed when no voltage is applied is applied. Note that a gate selection period ($t_1$) in the data writing scanning in the normal display is 5 μs/line.

In the period (period B) in which a voltage is not applied, the light transmittance is maintained based on the memory function of the ferroelectric liquid crystal, and the displayed image corresponding to the voltage (signal voltage D) applied just before this period is retained. In this period (period B), a gate-off voltage is applied to turn off the TFTs 21. Moreover, in this period (period B), the emission intensity of the back-light 30 is decreased to about 70% of that in the period (period A) in which a voltage is applied.

Thereafter, in order to display a different image, the application of voltage to the ferroelectric liquid crystal is resumed (timing E). At this time, after turning all pixels of the liquid crystal panel 1 to display black image, a voltage corresponding to desired display data is applied. In other words, when resuming the application of voltage to the ferroelectric liquid crystal, a voltage (signal voltage F) corresponding to a black image is first applied.

Figure 2:
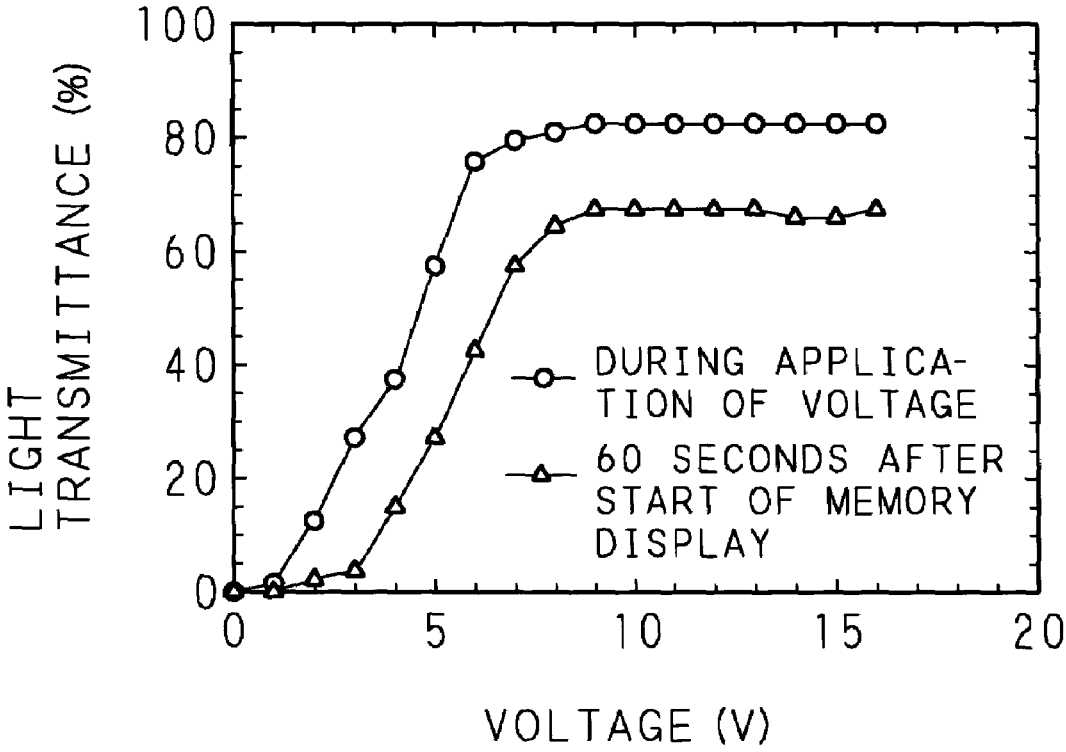
FIG. 2 is a graph showing one example of light transmittance when a voltage is applied and that when no voltage is applied.
Figure 3A:
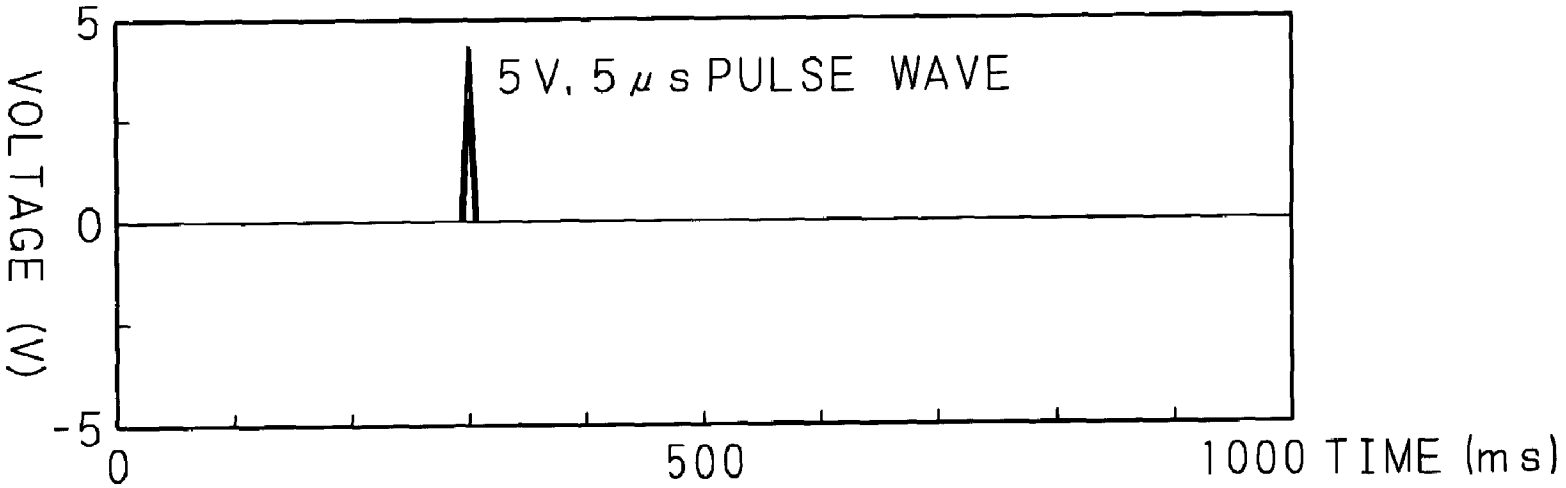
FIGS. 3A and 3B are graphs showing an example of application of pulse voltage and the resulting change in the light transmittance with time.
Figure 3B:
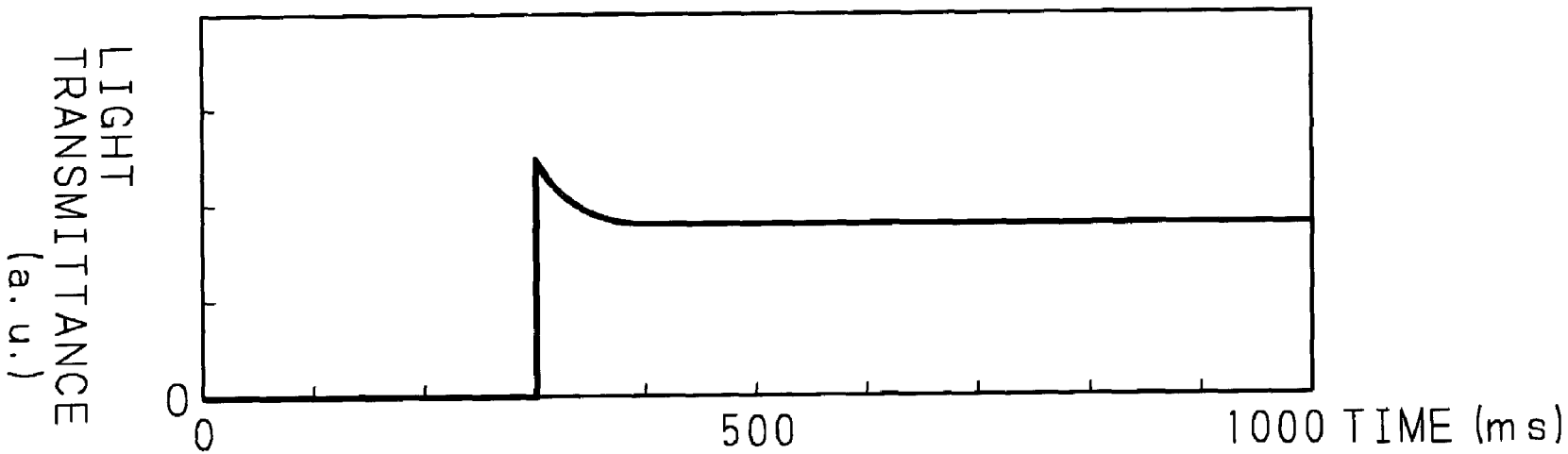

According to the drive sequence shown in FIG. 8, a voltage is applied on a line-by-line basis through the switching of the TFTs 21, and all voltages applied to the liquid crystal panel 1 are turned off at a desired timing after completion of the application of voltage to the last line. Further, the light transmittance during the application of voltage and the light transmittance at 60 seconds after the removal of voltage are measured while changing the value of the voltage applied to the liquid crystal panel 1. The measurement results show characteristics similar to FIG. 2 and FIGS. 3A and 3B. Thus, it can be understood that the light transmittance corresponding to the display state when the voltage is applied can be maintained by removing all voltages applied to the liquid crystal panel 1 according to the drive sequence of FIG. 8. As a result, it can be understood that it is possible to display an image without applying a voltage, that is, it is possible to certainly achieve a memory display.

Besides, this memory display state is stable even when the liquid crystal panel 1 is illuminated with strong light such as sun light. The reason for this is that charges do not flow out through the TFTs 21 because the TFTs 21 are turned off during the memory display period.

The adjustment of the emission intensity of the back-light 30 is investigated. During the normal voltage application (period A in FIG. 8), a positive voltage and a negative voltage are alternately applied to the liquid crystal. In the case of a ferroelectric liquid crystal having a half-V shaped electro-optic response characteristic, since light is transmitted only when the voltage of one polarity is applied, if the ratio of the positive voltage and negative voltage applied is 1 to 1, the average brightness is about a half of that when light is transmitted. On the other hand, the brightness when no voltage is applied is always uniform. Therefore, the brightness when no voltage is applied may be sometimes higher than that when a voltage is applied.

In order to solve such a problem, the brightness is adjusted by decreasing the emission intensity of the back-light 30 when no voltage is applied to about 70% of that in the normal display in synchronism with the removal of applied voltage (FIG. 8(*d*). Even when such an adjustment is performed, the display brightness is not decreased (FIG. 8(*e*)). This decrease of the emission intensity of the back-light 30 contributes to a reduction of power consumption and is therefore meaningful. Note that the emission intensity of the back-light 30 when no voltage is applied can be set arbitrarily, and if a further reduction is desired in the power consumption when no voltage is applied, it is of course possible to decrease the emission intensity of the back-light 30 to be less than about 70%. After resuming the application of voltage, the emission intensity of the back-light 30 is returned to the original value.

In addition, when resuming the application of voltage to the liquid crystal panel 1, a voltage corresponding to display data is applied to the liquid crystal panel 1 after turning all pixels of the liquid crystal panel 1 to display black image. Consequently, a high-quality color display including a moving-image display can be provided again.

Figure 9A:
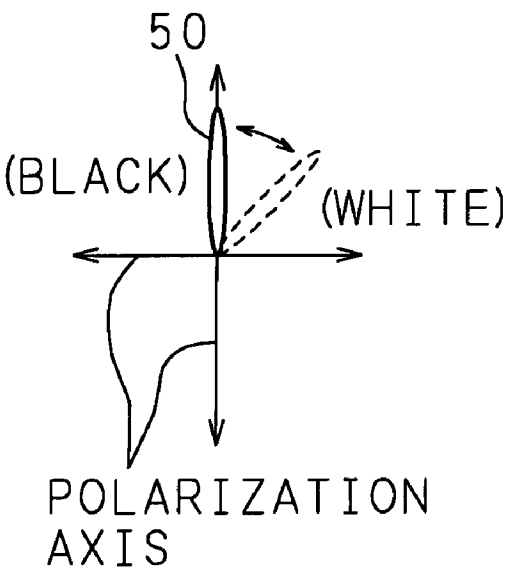
FIGS. 9A and 9B are views for explaining a change in light transmittance on a black base.
Figure 9B:
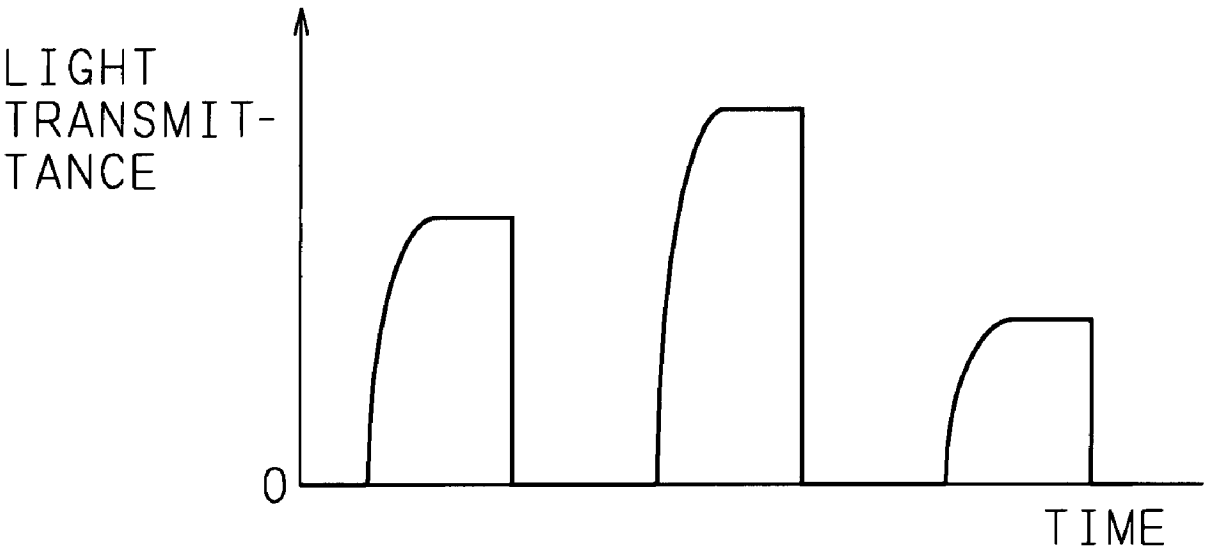
Figure 10A:
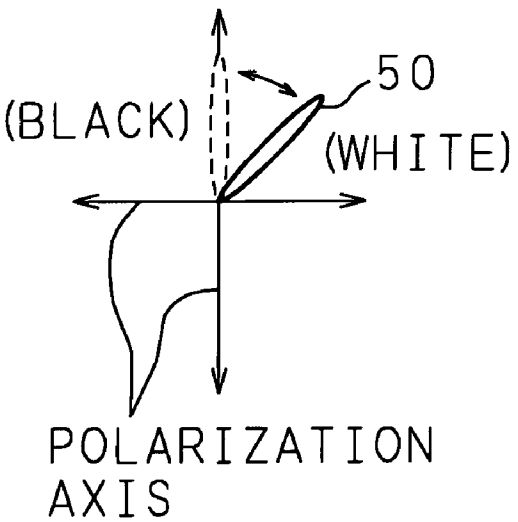
FIGS. 10A and 10B are views for explaining a change in light transmittance on a white base.
Figure 10B:
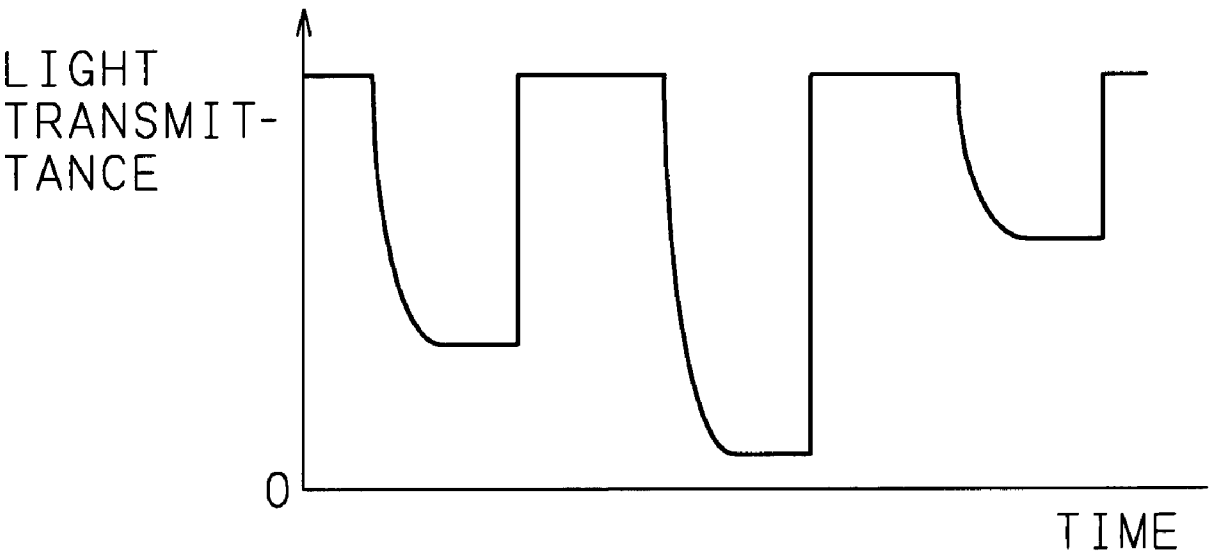

FIGS. 9A and 9B are views for explaining a change in light transmittance on a black base. As shown in FIG. 9A, a liquid crystal molecule 50 is initially positioned along a polarization axis (the position of black image shown by the solid line), and changes its orientation between this position and a position shifted from the polarization axis (the position of white image shown by the broken line) according to an applied voltage. One example of the change in the light transmittance at this time is shown in FIG. 9B. On the other hand, FIGS. 10A and 10B are views for explaining a change in light transmittance on a white base. As shown in FIG. 10A, the liquid crystal molecule 50 is initially in a position shifted from a polarization axis (the position of white image shown by the solid line), and changes its orientation between this position and a position along the polarization axis (the position of black image shown by the broken line) according to an applied voltage. One example of a change in the light transmittance at this time is shown in FIG. 10B.

When resuming the application of voltage, if a voltage corresponding to desired display data is applied after turning all pixels of the liquid crystal panel 1 to display black image, a black-base image is definitely provided as shown in FIG. 9B, and a bright display can be obtained. On the other hand, when resuming the application of voltage, if all pixels of the liquid crystal panel 1 are not caused to display black image once, a problem occurs. For example, if the display retained when no voltage is applied is an image other than black image, particularly a white image, a white-base image is provided as shown in FIG. 10B by resuming the application of voltage, and consequently the desired display can not be obtained.

According to the above-described structures, it is possible to realize the same image display when a voltage is applied and when no voltage is applied. The power consumption during the application of voltage is specifically 2.5 W. On the other hand, the power consumption when no voltage is applied is specifically 1.5 W, and thus the power consumption is low.

Second Embodiment

Figure 11:
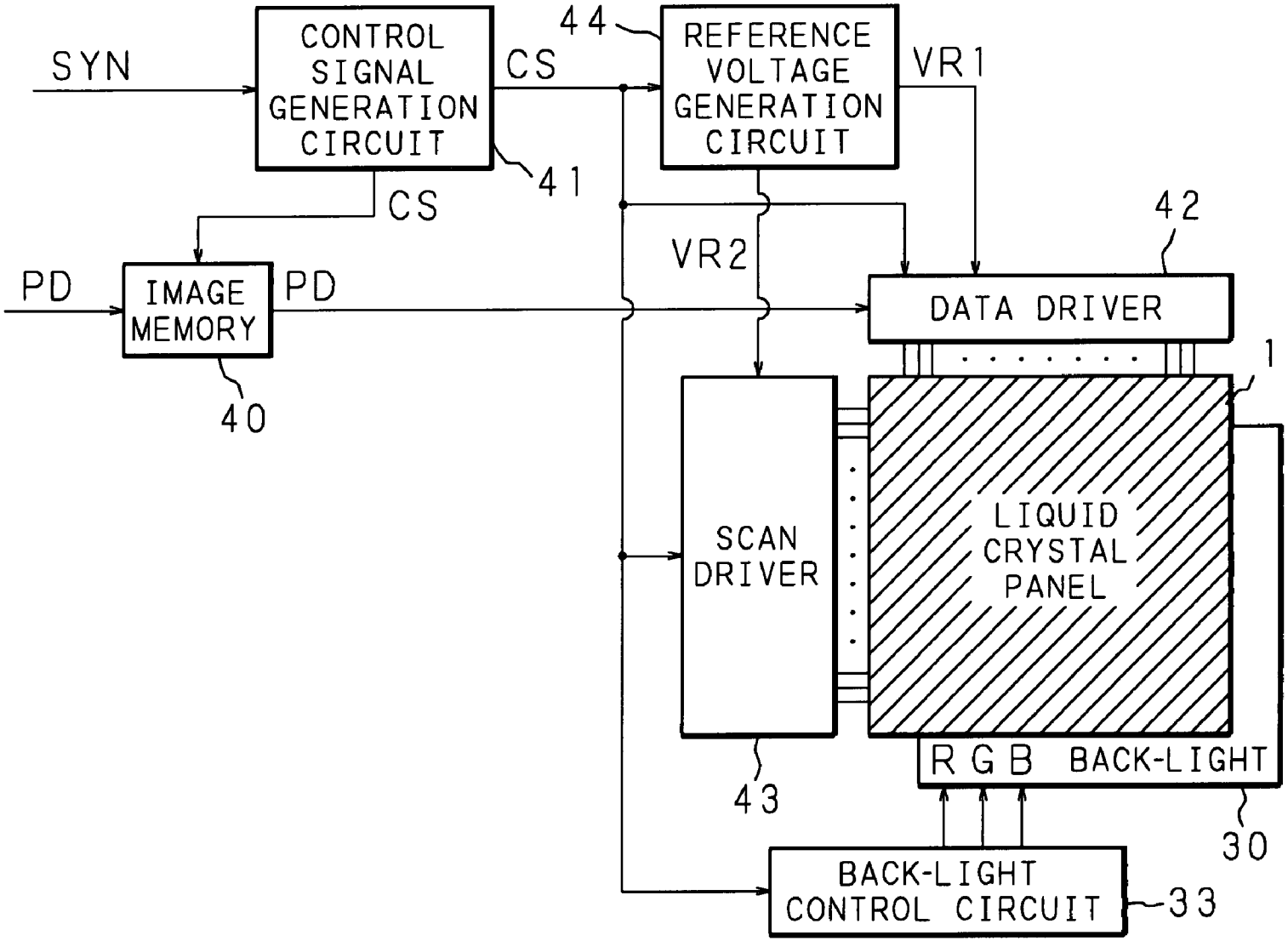
FIG. 11 is a block diagram showing the circuit structure of a liquid crystal display device of a second embodiment (field-sequential type)
Figure 12:
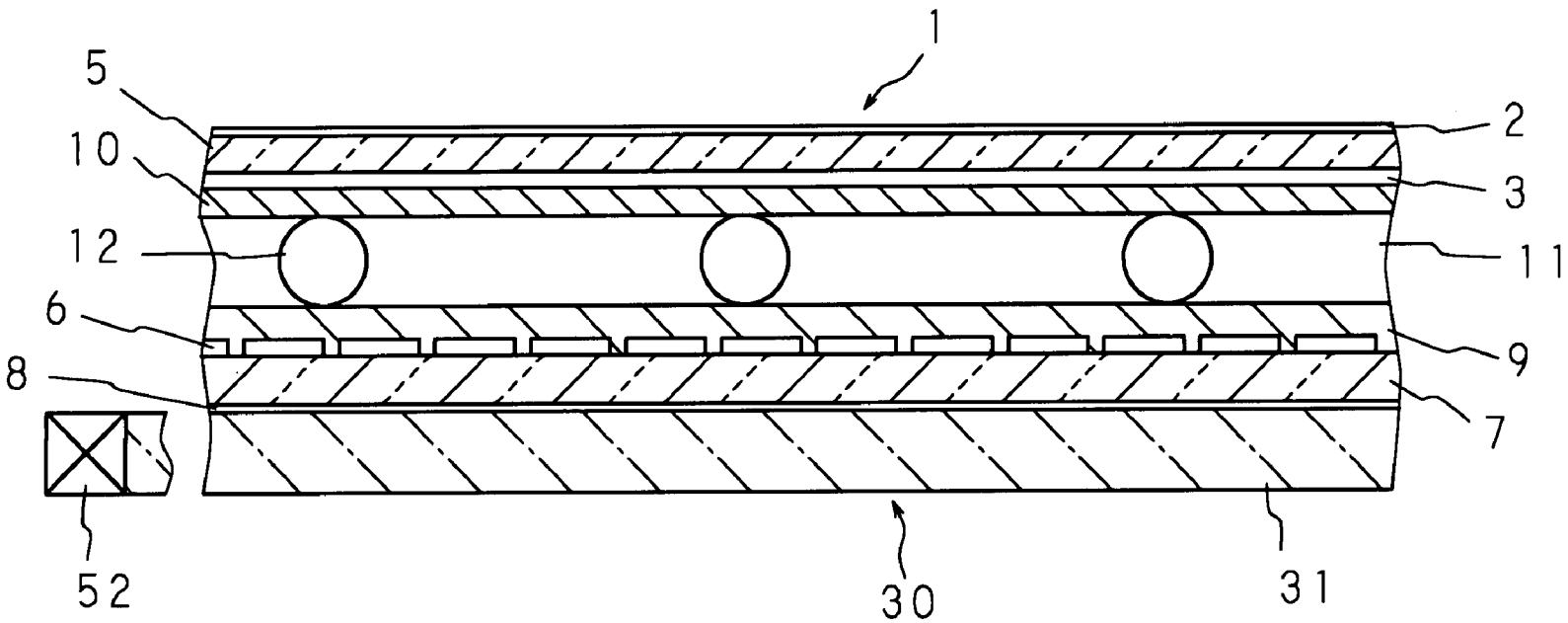
FIG. 12 is a schematic cross sectional view of a liquid crystal panel and back-light of a liquid crystal display device of the second embodiment.
Figure 13:
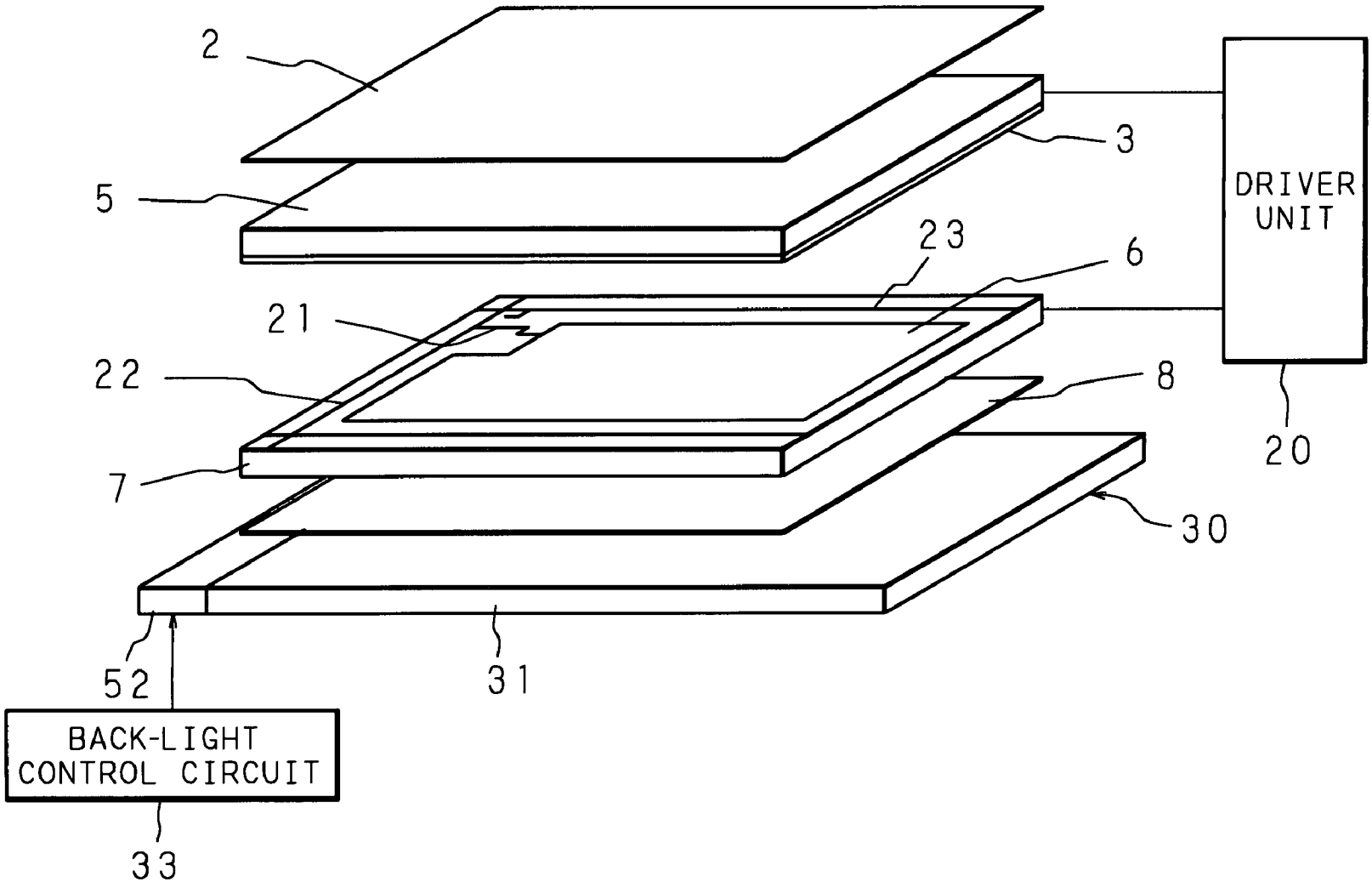
FIG. 13 is a schematic view showing an example of the overall structure of the liquid crystal display device of the second embodiment.

FIG. 11 is a block diagram showing the circuit structure of a liquid crystal display device of a second embodiment; FIG. 12 is a schematic cross sectional view of a liquid crystal panel and back-light of the liquid crystal display device; and FIG. 13 is a schematic view showing an example of the overall structure of the liquid crystal display device. The second embodiment is a liquid crystal display device for displaying color images by a field-sequential method. In FIGS. 11 through 13, parts that are the same as or similar to those in FIGS. 4 through 6 are designated with the same numbers.

In this liquid crystal panel 1, color filters shown in the first embodiment (FIGS. 5 and 6) are not present. Moreover, the back-light 30 is disposed on the lower layer (rear face) side of the liquid crystal panel 1, and has an LED array 52 placed to face an end face of the light guiding and diffusing plate 31 that forms a light emitting area. This LED array 52 comprises a plurality of LEDs, one LED chip being composed of LED elements that emit light of the three primary colors, namely red, green and blue, on a face facing the light guiding and diffusing plate 31. The LED array 52 turns on the red, green and blue LED elements in red, green and blue sub-frames, respectively. The light guiding and diffusing plate 31 guides the light emitted from the respective LEDs of the LED array 52 to its entire surface and diffuses the light to the upper face, thereby functioning as the light emitting area.

The liquid crystal panel 1 and the back-light 30 capable of emitting red, green and blue light in a time-divided manner are stacked one upon another. The color of emitted light, ON timing and emission intensity of the back-light 30 are controlled by a back-light control circuit 33 in synchronism with data writing scanning based on the display data on the liquid crystal panel 1.

A specific example of the liquid crystal display device of the second embodiment is explained. After washing a TFT substrate having pixel electrodes 6 (640×480, 3.2-inch diagonal) and a common electrode substrate having a common electrode 3, they were coated with polyimide and baked for one hour at 200° C. to form about 200 Å thick polyimide films as alignment films 9 and 10. Further, these alignment films 9 and 10 were rubbed with rayon fabric, and an empty panel was produced by stacking these two substrates while maintaining a gap therebetween by spacers 12 made of silica having an average particle size of 1.6 μm. A liquid crystal layer 11 was formed by sealing a mono-stable ferroelectric liquid crystal material showing a half-V shaped electro-optic response characteristic as shown in FIG. 1 during TFT driving (for example, R2301 available from Clariant Japan) in the empty panel. The magnitude of spontaneous polarization of the sealed ferroelectric liquid crystal material was about 6 $nC/cm^2$.

After the sealing process, by applying a DC voltage of 10 V over a transition point from the cholestric phase to chiral smectic C phase, a uniform liquid crystal alignment state was realized. A liquid crystal panel 1 was produced by sandwiching the fabricated panel by two polarization films 2 and 8 arranged in a crossed-Nicol state so that a dark state was produced when no voltage was applied. This liquid crystal panel 1 and the back-light 30 were stacked one upon another to achieve a color display by a filed-sequential method.

Figure 14:
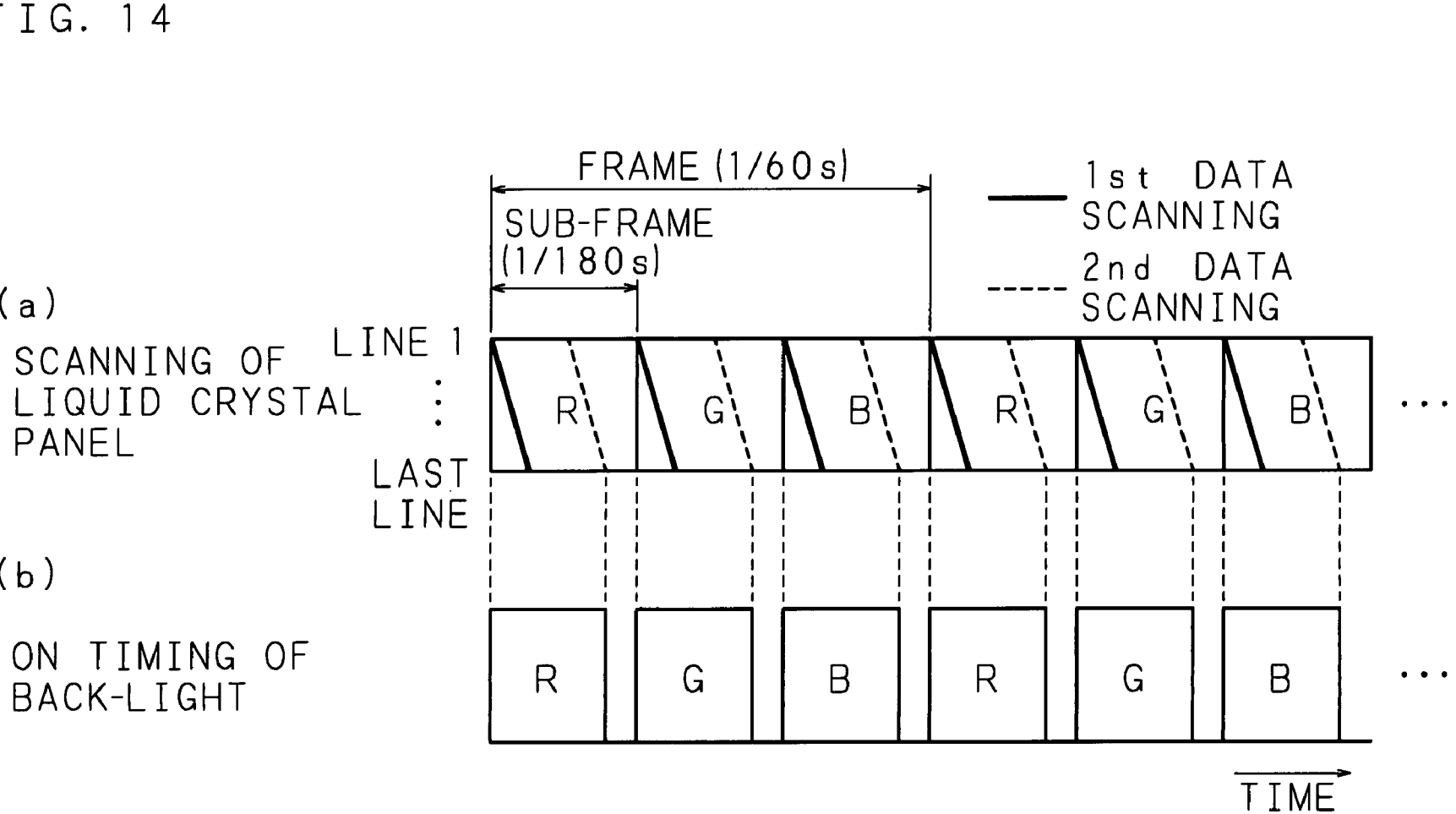
FIG. 14 is a drive sequence of the liquid crystal display device of the second embodiment.

Next, a specific example of operation of the second embodiment is explained. FIG. 14 and FIG. 8 are timing charts showing one example of a drive sequence in this operation example. FIG. 14(*a*) shows the scanning timing of each line of the liquid crystal panel 1, and FIG. 14(*b*) shows the ON timing of red, green and blue colors of the back-light 30. One frame is divided into three sub-frames, and, for example, as shown in FIG. 14(*b*), red light is emitted in the first sub-frame, green light is emitted in the second sub-frame, and blue light is emitted in the third sub-frame. On the other hand, as shown in FIG. 14(*a*), image data writing scanning is performed twice in each sub-frame of red, green and blue colors on the liquid crystal panel 1. In the first data writing scanning, data writing scanning is performed in a polarity capable of realizing a bright display, and in the second data writing scanning, a voltage with the opposite polarity and substantially equal magnitude to that in the first data writing scanning is applied. Consequently, a darker display is realized compared to the first data writing scanning and practically recognized as a "black image".

Next, similarly to the first embodiment, according to the drive sequence shown in FIG. 8, a voltage is applied to the liquid crystal through the switching of the TFTs 21 on a line-by-line basis, and the data writing scanning is stopped by turning off all voltages applied to the liquid crystal panel 1 at a desired timing after completion of the application of voltage to the last line. In addition, a gate-off voltage is applied to the TFTs 21 to turn off the TFTs 21. Data writing scanning performed just before stopping data writing scanning is writing scanning of monochrome display data desired to be displayed when no voltage is applied. Besides, during the memory display, the back-light 30 is switched to white light, and the emission intensity is lowered compared to that in the normal display. Note that, similarly to the first embodiment, the gate selection period ($t_1$) during data writing scanning in the normal display is 5 μs/line.

According to the above-described structures, when a voltage is applied, a high-quality display including a moving-image display is obtained, and when the voltage is removed, a monochrome display is obtained with lower power consumption by switching the back-light 30 to white light adjusted to a desired intensity value. This memory display state is stable even when the liquid crystal panel 1 is illuminated with strong light such as sun light.

When resuming the application of voltage to the liquid crystal panel 1, a voltage corresponding to display data is applied to the liquid crystal panel 1 after turning all pixels of the liquid crystal panel 1 to display black image. Accordingly, it is possible to obtain a high-quality display including a moving-image display again after resuming the application of voltage.

The power consumed when a color moving-image is displayed by applying a voltage is specifically 1.5 W. On the other hand, the power consumed during a monochrome display without applying a voltage is specifically 0.73 W, and thus the power consumption is low.

Note that, in the above-described second embodiment, the back-light 30 is switched to white light when the voltage is removed, red, green and blue emission in a time-divided manner may be retained, or mono-color emission may be used. In the above-described first and second embodiments, the transmission type liquid crystal display devices have been explained, but it is needless to say that the present invention is also applicable similarly to reflection type or semi-transmission type liquid crystal display devices. In the case of the reflection type or semi-transmission type liquid crystal display devices, it is possible to display an image without using a light source such as a back-light, and the power consumption can be decreased to nearly 0 by combining it with the memory display function. Moreover, although the above embodiments use a liquid crystal material having spontaneous polarization in a half-V shaped electro-optic response characteristic, it is needless to say that the same effects can also be obtained by using a liquid crystal material having spontaneous polarization in a V shaped electro-optic response characteristic.

As described above, in a liquid crystal display device of the present invention, since the switching elements (TFT) are turned off while the second display function (memory display function) is being executed, it is possible to stably maintain an amount of charges in each pixel for determining a plurality of display states of different brightness by the liquid crystal and obtain a stable display state. As a result, it is possible to realize a stable memory display, it is also possible to significantly reduce the number of times of voltage application to the liquid crystal material through the switching elements (TFT), thereby reducing power consumption.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A liquid crystal display device comprising:

at least two substrates that form a gap in which a liquid crystal material having spontaneous polarization is sealed;

switching elements corresponding to respective pixels, for controlling selection/non-selection of voltage application so as to control light transmittance of the liquid crystal material; and a display control section for controlling display of an image through the switching elements, wherein the display control section controls the switching elements, so that the switching elements switch the respective pixels between an ON state and an OFF state in the following manner, in the ON state, a display voltage, which is not zero and has a first polarity, is ready to be applied to the pixel, in the ON state, a direction of the spontaneous polarization of the liquid crystal material included in the pixel swings in accordance with a magnitude of the display voltage, in the OFF state, the pixel thus switched maintains an amount of charge therein to retain the direction of the spontaneous polarization of the sealed liquid crystal material in a stable state, and in the OFF state, the amount of charge produces a transmittance of the liquid crystal material within the pixel and the transmittance is stable in the stable state.

2. The liquid crystal display device of claim 1, wherein the display control section comprises a switch section for performing switching from the first display function to the second display function when inputted image data is still-image data.

3. The liquid crystal display device of claim 1, wherein the display control section comprises a switch section for performing switching from the first display function to the second display function when an operating input by an operator has not been detected over a predetermined period of time.

4. The liquid crystal display device of claim 1, wherein the display control section comprises a switch section for performing switching from the first display function to the second display function when the second display function is selected by an operator.

5. The liquid crystal display device of claim 1, further comprising a light source for display, wherein the light source has different emission intensities between the first display function and the second display function.

6. The liquid crystal display device of claim 5, wherein before stopping the application of voltage to the liquid crystal material, a voltage corresponding to an image to be displayed after stopping the application of voltage is applied to the liquid crystal material.

7. The liquid crystal display device of claim 5, wherein all pixels are caused to display black image before resuming the application of voltage to the liquid crystal material to return to the first display function from the second display function.

8. The liquid crystal display device of claim 1, wherein before stopping the application of voltage to the liquid crystal material, a voltage corresponding to an image to be displayed after stopping the application of voltage is applied to the liquid crystal material.

9. The liquid crystal display device of claim 8, wherein all pixels are caused to display black image before resuming the application of voltage to the liquid crystal material to return to the first display function from the second display function.

10. The liquid crystal display device of claim 1, wherein all pixels are caused to display black image before resuming the application of voltage to the liquid crystal material to return to the first display function from the second display function.

11. The liquid crystal display device of claim 1, wherein the liquid crystal material is a ferroelectric liquid crystal material.

12. The liquid crystal display device of claim 1, wherein the liquid crystal display device is of transmission type, reflection type, or semi-transmission type.

13. The liquid crystal display device of claim 1, wherein a color image is displayed by a color-filter method.

14. The liquid crystal display device of claim 1, wherein a color image is displayed by a field-sequential method.

* * * * *